US011852453B2

(12) United States Patent
Keller

(10) Patent No.: US 11,852,453 B2
(45) Date of Patent: Dec. 26, 2023

(54) DART FLIGHT

(71) Applicant: Claude E. Keller, Mount Morris, IL (US)

(72) Inventor: Claude E. Keller, Mount Morris, IL (US)

( * ) Notice: Subject to any disclaimer, the term of this patent is extended or adjusted under 35 U.S.C. 154(b) by 0 days.

(21) Appl. No.: 17/866,997

(22) Filed: Jul. 18, 2022

(65) Prior Publication Data

US 2023/0113955 A1 Apr. 13, 2023

Related U.S. Application Data

(60) Provisional application No. 63/253,226, filed on Oct. 7, 2021.

(51) Int. Cl.

| | |
|---|---|
| ***A63B 65/02*** | (2006.01) |
| ***F42B 6/06*** | (2006.01) |
| ***F42B 6/00*** | (2006.01) |

(52) U.S. Cl.

CPC ..... *F42B 6/003* (2013.01)

(58) Field of Classification Search

CPC ..... F42B 6/003; F42B 6/06

See application file for complete search history.

(56) References Cited

U.S. PATENT DOCUMENTS

| | | | | |
|---|---|---|---|---|
| 2,887,319 A * | 5/1959 | Lay | F42B 6/06 | 473/586 |
| 3,815,916 A * | 6/1974 | Meszaros | F42B 6/06 | 273/DIG. 8 |
| 4,204,307 A * | 5/1980 | Pfetzing | F42B 6/06 | 29/418 |
| 4,502,692 A * | 3/1985 | Humphrey | F42B 6/06 | 473/586 |
| 5,846,147 A * | 12/1998 | Basik | F42B 10/12 | 473/585 |
| 9,046,330 B2 * | 6/2015 | Pedersen | F42B 6/06 | |
| 9,435,620 B2 * | 9/2016 | Hamazaki | F42B 6/003 | |

* cited by examiner

*Primary Examiner* — John A Ricci

(74) *Attorney, Agent, or Firm* — MARSHALL, GERSTEIN & BORUN LLP

(57) ABSTRACT

A new dart has an integrally formed flight part that is made of thin plastic with a uniform thickness. The flight part has a set of flexible blades that are radially offset, with the width of each blades being coplanar, and extending perpendicular to the longitudinal axis of a stem on which a barrel and dart tip are connected. Edges on a central portion of the flight part engage cooperating surfaces on a retainer, locking the retainer and the flight part against rotation with respect to each other. A self-lubricating bearing fits over the a stem and is used to connect to the flight part and the retainer for rotation with respect to a barrel and dart tip. A channel extends along the length of each blade. A bubble is positioned outwardly of the channel.

8 Claims, 14 Drawing Sheets

DART FLIGHT

BACKGROUND OF THE INVENTION

The present invention relates generally to darts but can be applied to more generally to other projectiles such as arrows.

A typical dart has a stem with a pointed tip mounted at its front end and a rear stabilizer called a flight mounted at its back end. The flight traditionally includes a set of planar surfaces that extend axially along the length of the back of the dart, and are aligned parallel to the length of the dart, offset from each other radially at equal angular distances.

BRIEF SUMMARY

The applicant has developed an alternative dart construction.

BRIEF DESCRIPTION OF THE DRAWINGS

The invention can be better understood by referring to the accompanying drawings, in which.

DETAILED DESCRIPTION

Figure 1:
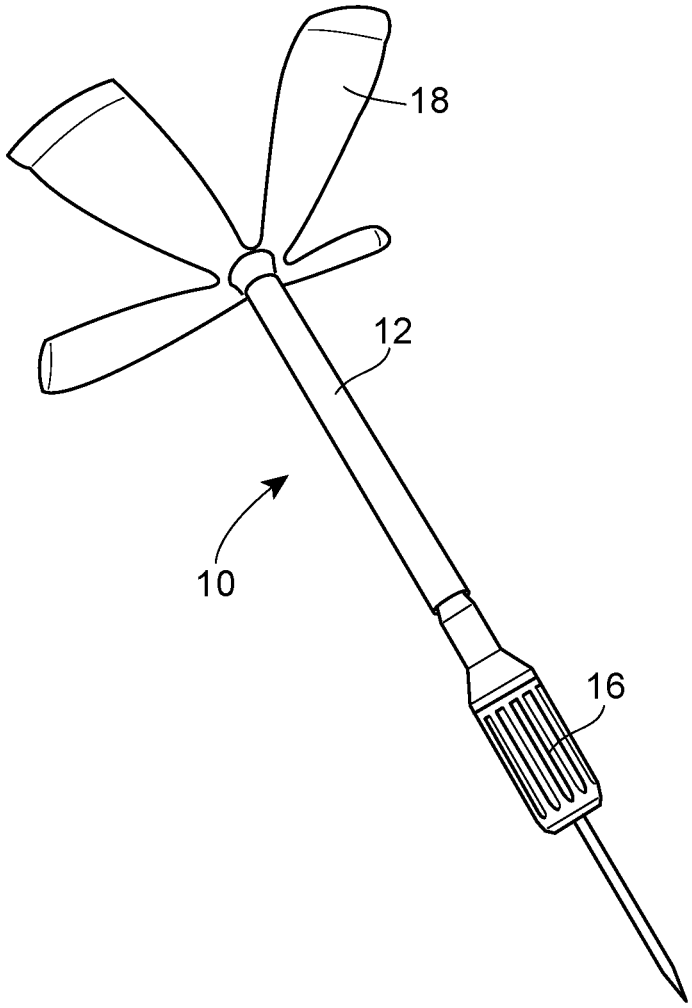
FIG. 1 is perspective view of a dart that utilizes the new invention.
Figure 2:
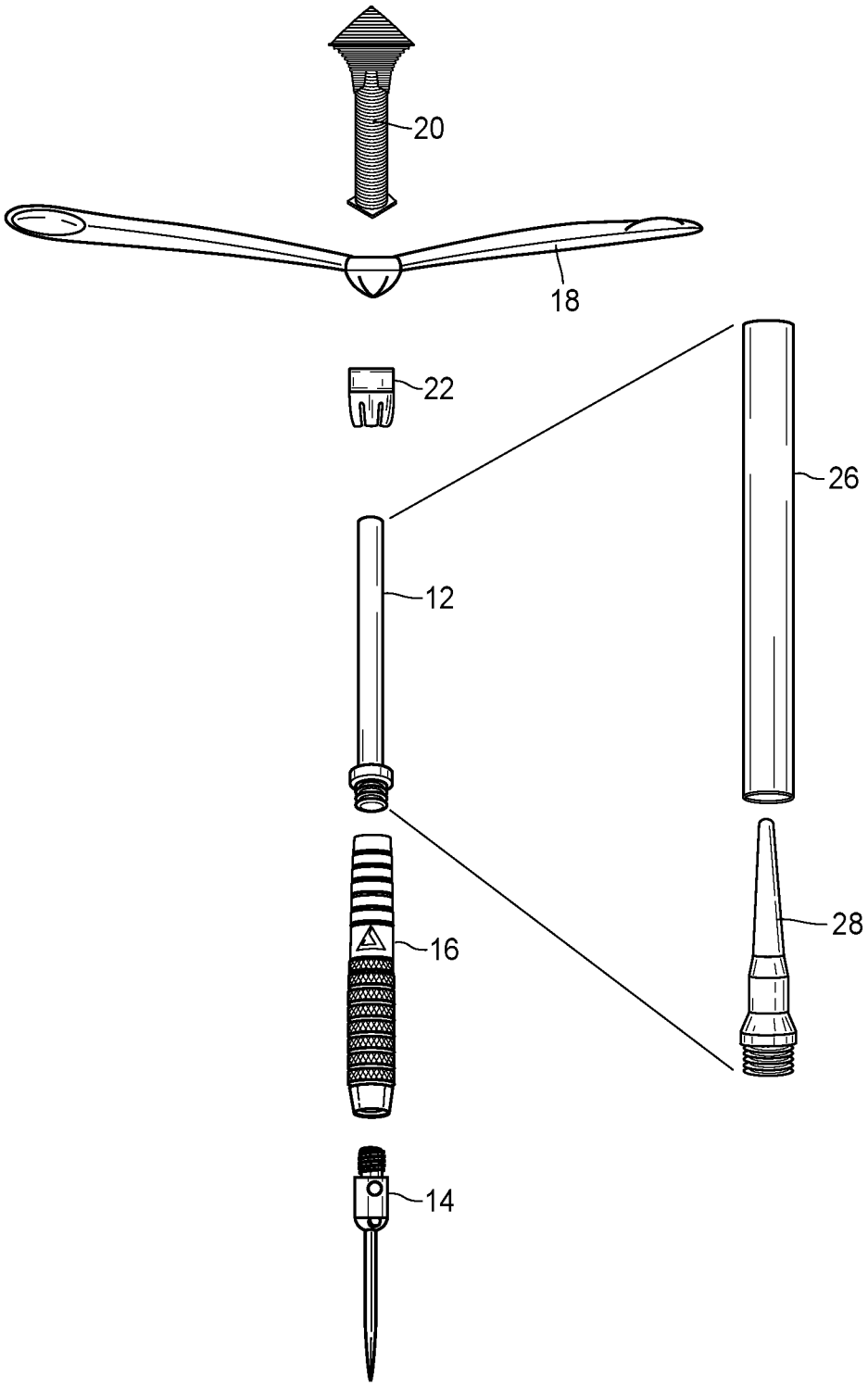
FIG. 2 is an exploded view.

The applicant has developed a new dart 10 that has six pieces, a stem 12, a dart point 14, a barrel 16, a flight part 18, a retainer 20, and a bearing 22. He has also developed a simpler version that does not require a bearing.

The Stem

The illustrated stem 12 includes a hollow tube 26 that has a longitudinal axis. The illustrated stem has a conventional threaded connector 28 secured in the front end. The illustrated threaded connector, which is a stock item, is glued in place.

Figure 3:
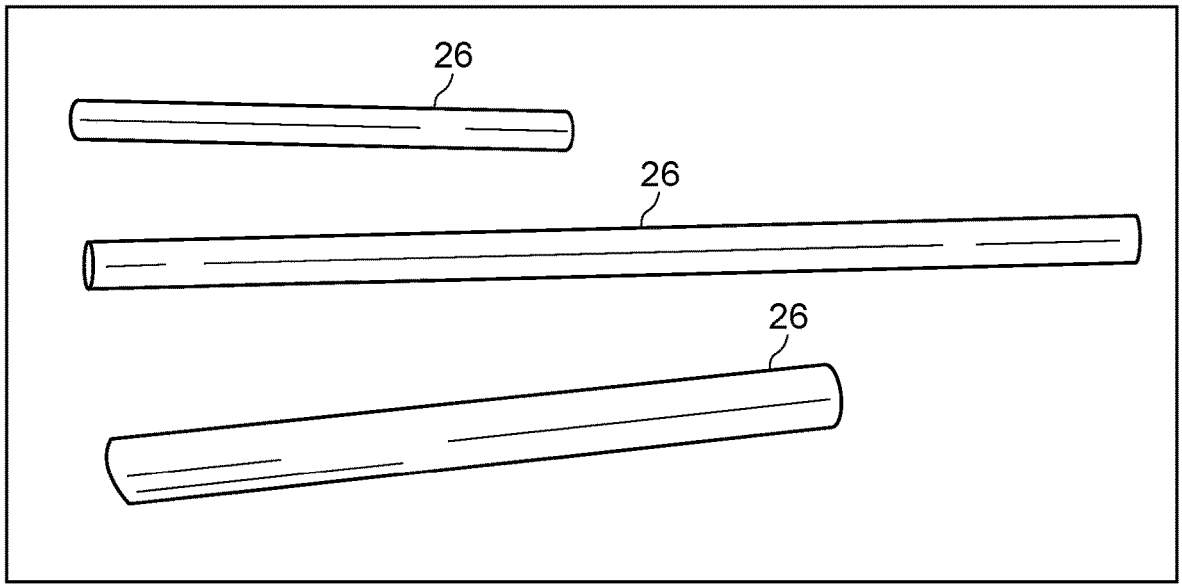
FIG. 3 is a view of tube options for the stem of the dart.

As seen in FIG. 3, the hollow tube 26 can be of any of a variety of thicknesses, from a standard diameter of around ⅛" inch to an ultra-thin diameter of around 1/16". In the embodiment illustrated in FIG. 1, the tube is 2" long. For conventional darts, the length can vary by an inch or so.

The Dart Point and the Barrel

Figure 4:
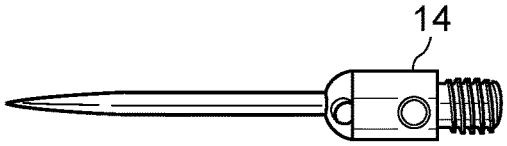
Fig. 4 (Prior art)
FIG. 4 is a view of a dart tip that can be used in the dart.
Figure 5:
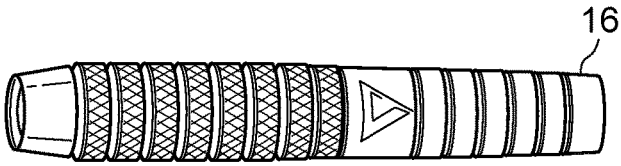
Fig. 5 (Prior art)
FIG. 5 is a view of a barrel that can be used in the dart.

The illustrated dart point 14 seen in FIG. 4 is a conventional metal or plastic point, a stock item. The illustrated point screws onto the front end of the barrel 16, though other means of connection are known and obvious. The barrel illustrated in FIG. 5 has a receptacle at its back end, as is conventional. The configuration of the dart point and barrel are not important to the new invention, nor is the means by which they connect to the stem. The dart point and barrel can connect to the stem in other ways and need not be removable from the barrel, as they are here.

The Flight Part

Figure 6:
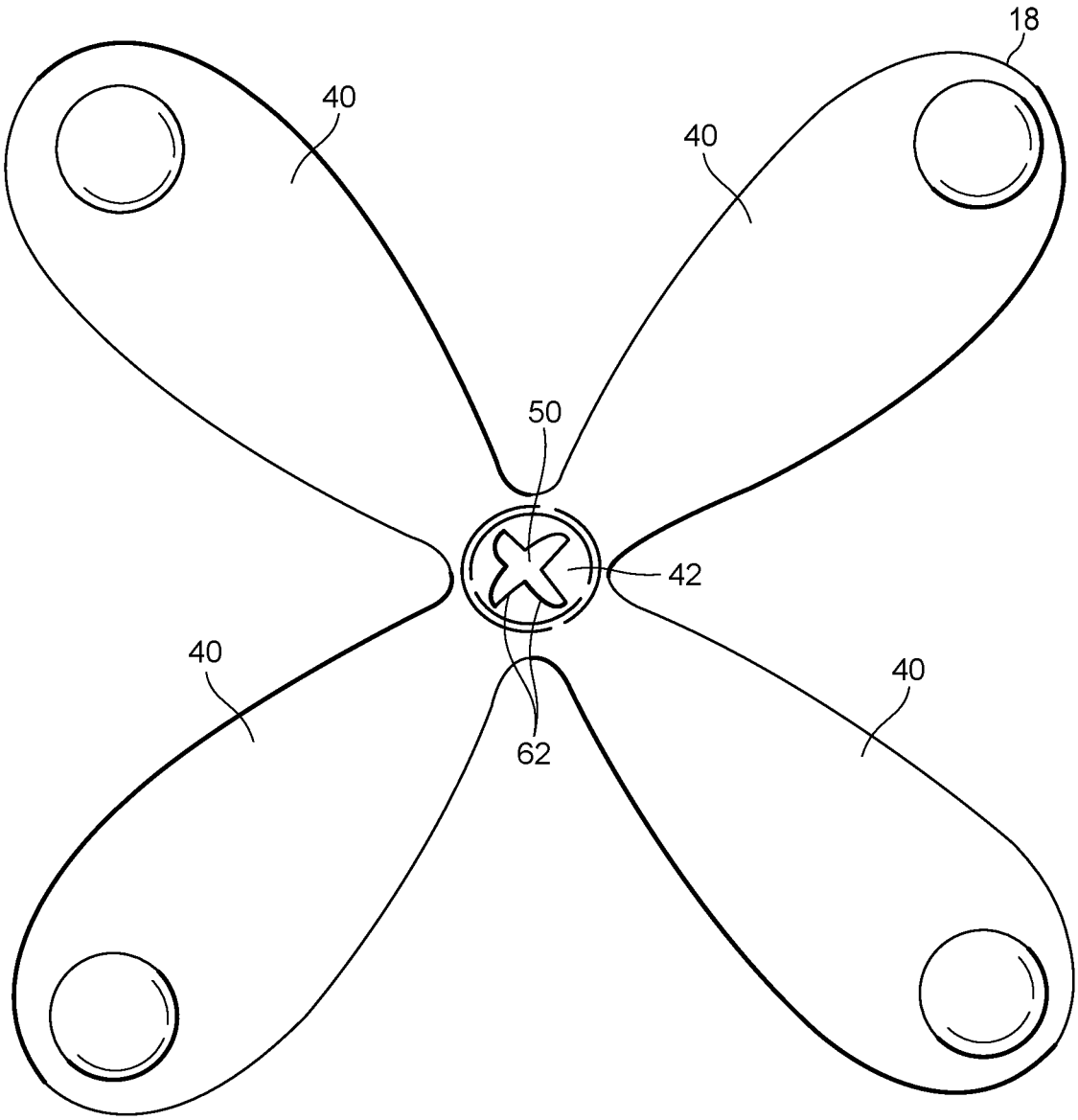
FIGS. 6-8 are views of the flight part of the dart.

The flight part 18 seen in FIG. 6 is cut from a piece of thin plastic with a uniform thickness. The illustrated flight part is cut from plastic Mylar film that is between 5 and 7/1000's of an inch thick. The film is light and moderately flexible: it holds it shape against the force of gravity, but may deflect slightly when the dart is thrown. The overall diameter of the illustrated flight part is approximately 1¾". Conventional darts could be made from other embodiments from as small as ¾" in diameter to as large as 3" in diameter. Other sizes could be as or more useful in other applications.

The illustrated flight part 18 has a set of four flexible blades 40 that extend outwardly from a central portion 42 of the flight part. The center portion of the illustrated flight part is approximately ⅜" in diameter. The blades are arranged with the width of each blade extending in a radial direction, perpendicular to the longitudinal axis of the stem. Each blade varies from around ¼" in width near the center portion to about ⅝" at its widest point, about ½" away. These dimensions (and relative proportions) could vary be 50-75% in other conventional darts.

The illustrated blades 40 are offset from each other and set at equal angular distances from each other. The number of blades could be varied. For example, a three-bladed flight could be useful in some settings. A six-bladed dart could be made by rotationally offsetting and overlapping a pair of three-bladed flight parts.

The central portion 42 of the illustrated flight part 18 has an x-shaped incision 50, typically spanning typically 25-75% of the width of the central portion. The incision forms four inwardly extending triangular sections that are bent forwardly to form a center cone 60 that rises approximately 64/1000" away from the plane of the flight part. The edges 62 of these triangular portions are used to secure the flight part in place, as will be discussed below in connection with the retainer.

Figure 7:
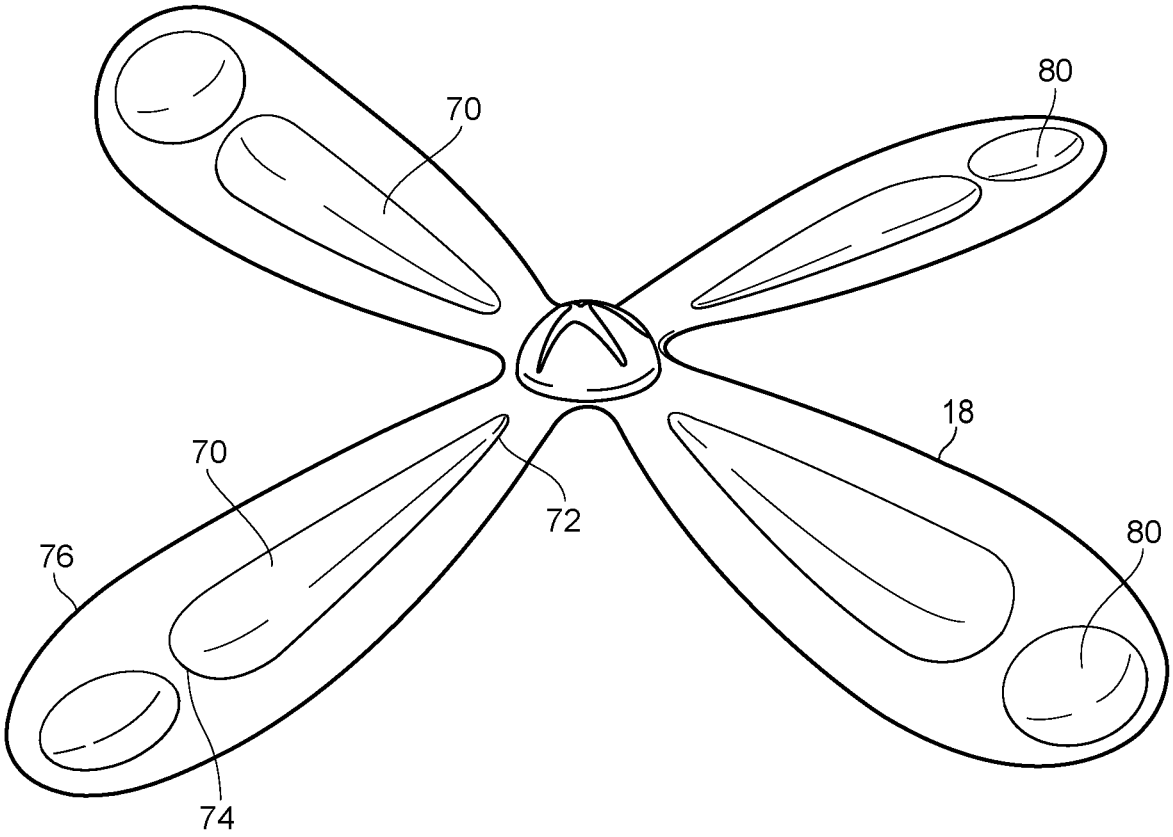
Figure 8:
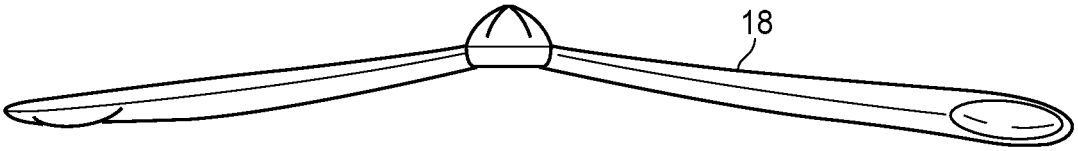

As seen in FIG. 7, each of the blades 40 in the illustrated dart has a channel 70 that extends along the length of the blade, from a proximal end 72 near the central part of the flight part to a distal end 74 on the distal half 76 of the blade. When installed, the channels extend toward the back of the dart. Each channel has a maximum depth that exceeds the thickness of the thin plastic by a factor of at least four. The illustrated channels extend about 40/1000" from the plane of the blade. The channels can be formed be pressing the flight part in a suitable mold. The illustrated channels are approximately ½" long and ¼" wide at their widest part, with the lateral distance between the side of the channel and the edge side edge of the blade typically being at least 1/16" at all points of the channel. The distal portions of the illustrated channel are wider than the proximal portions of the channel.

Each of the blades 40 in the illustrated dart also has a bubble 80 that is positioned outwardly of the channel 70 on that blade. The illustrated bubble has a diameter of approximately 5/16". Like the channels, each bubble has a maximum depth that exceeds the thickness of the thin plastic by a factor of at least four. The illustrated bubbles extend about 40/1000" from the plane of the blade. Like the channels, the bubbles can be formed by pressing the flight part 18 in a suitable mold.

The Retainer

Figure 9:
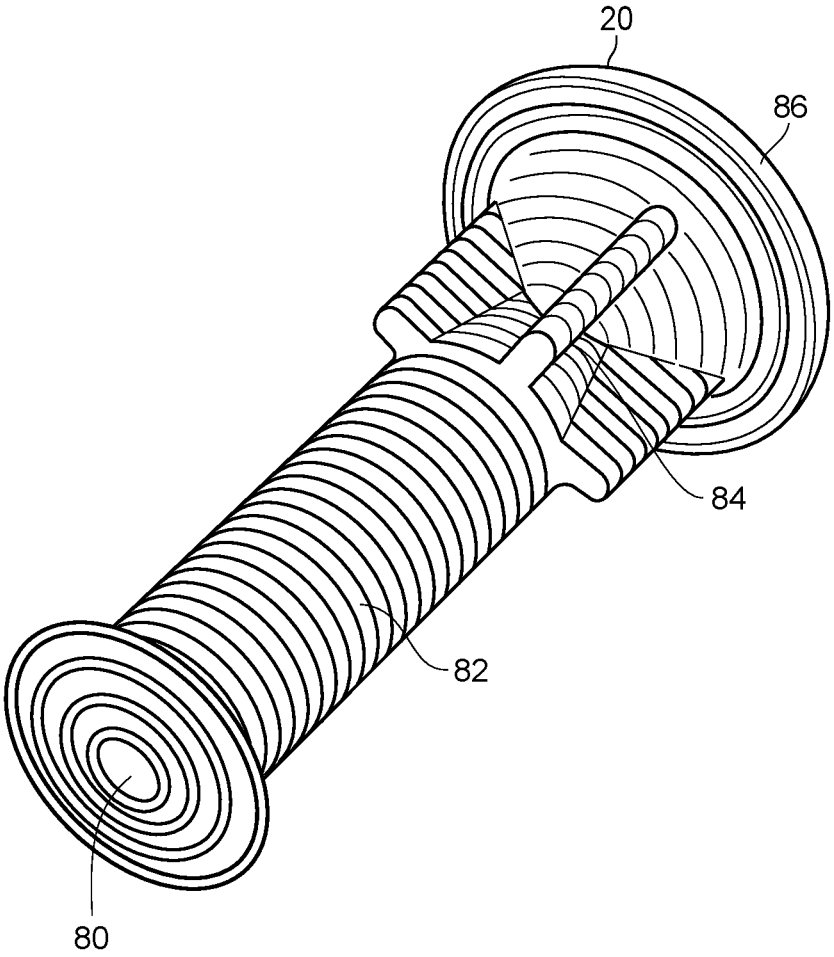
FIG. 9 is a view of one version of a hub for the dart.
Figure 10:
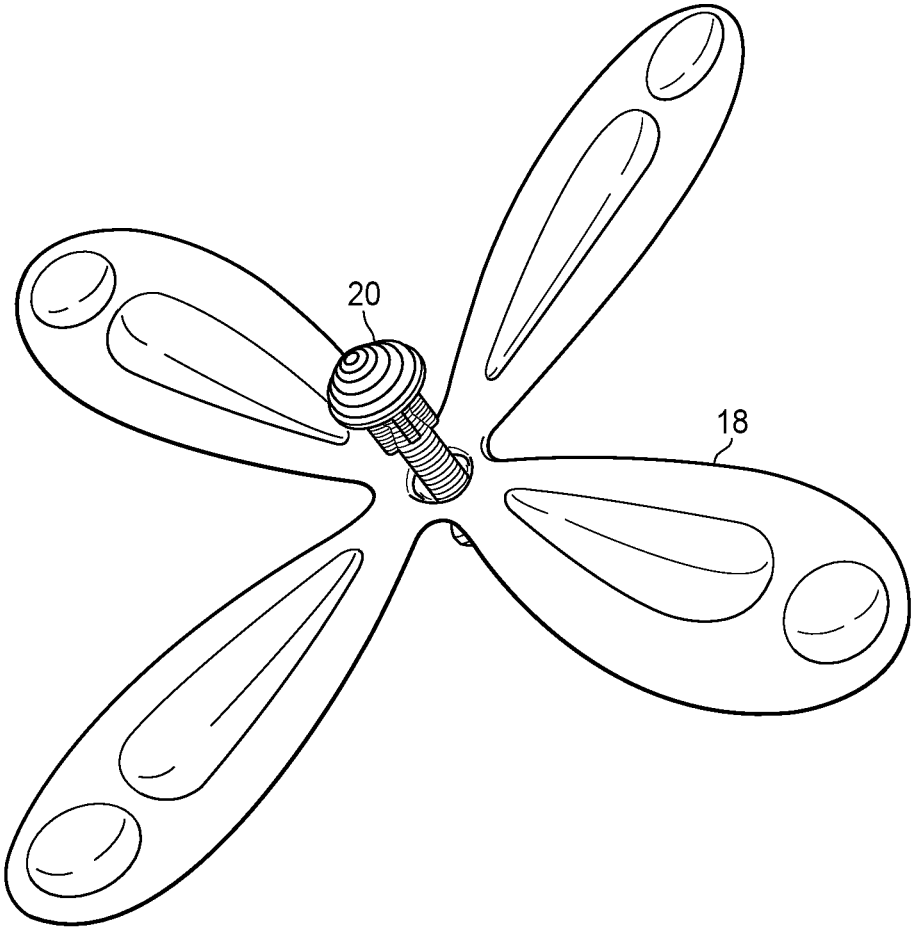
FIG. 10 shows the flight part being installed on the hub.
Figure 11:
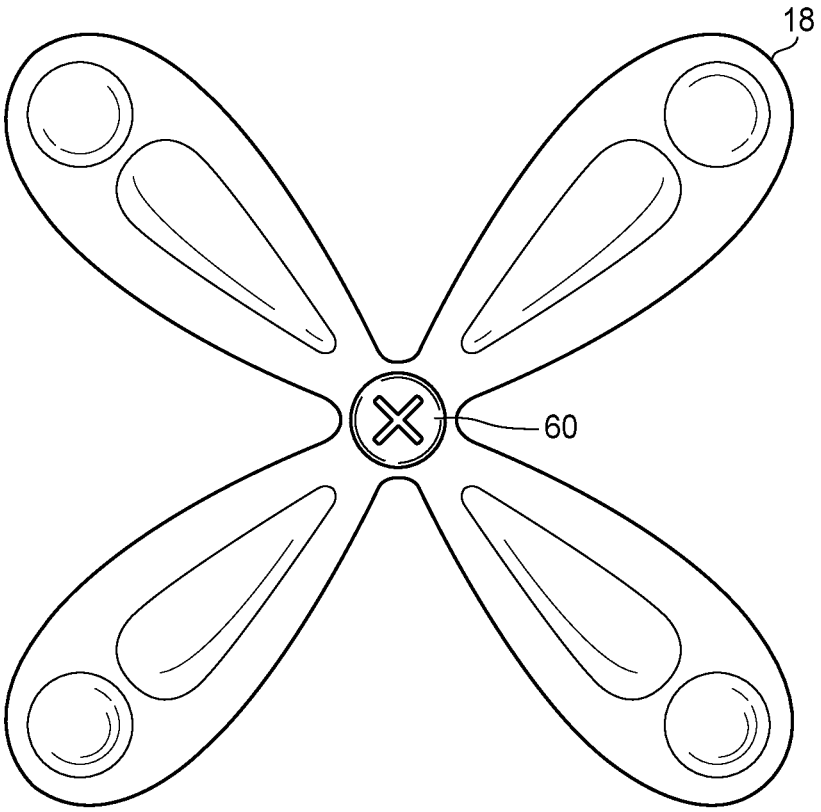
FIGS. 11 and 12 are views of the flight part installed on the hub.

The illustrated retainer 20 seen in FIG. 9 is a unitary plastic part that has a knob 80, a shaft 82, a locking portion 84, and a back cone 86.

Figure 12:
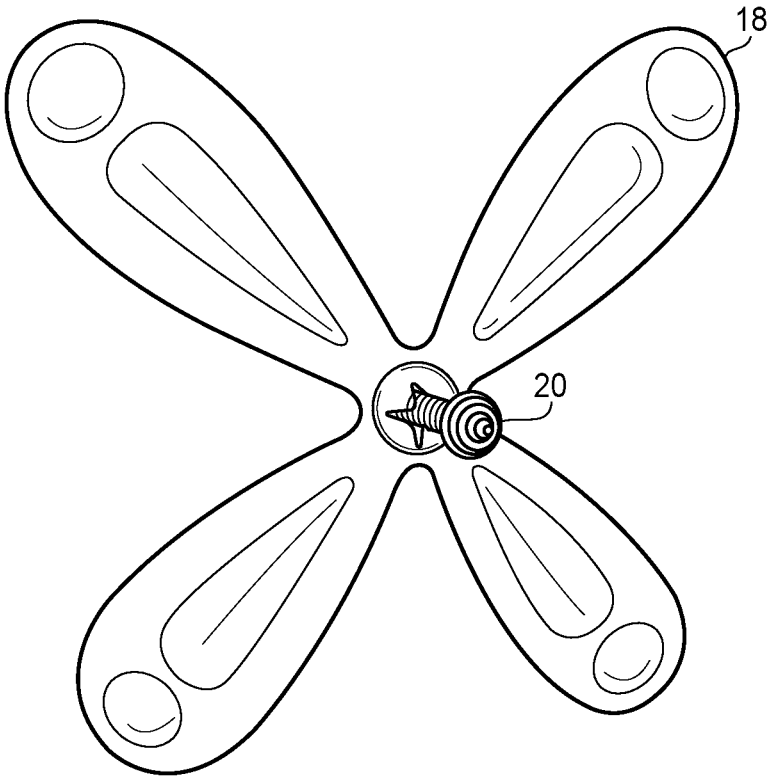

When assembling the dart, the center cone 60 of the flight part 18 of the dart is pressed over the knob 80 of the shaft 82 as seen in FIG. 12, the incision on the center cone of the flight part opening to enable the flight part to pass over the knob and onto the shaft of the retainer. The flight part is then pressed back toward the locking portion 84 of the retainer. The shaft of the illustrated retainer has a diameter of about 1/16". The knob has a slightly larger diameter.

The locking portion 84 of the retainer 20 has set of shoulders that rise outwardly from the shaft 82. The illustrated locking portion has four shoulders, one for each end point of the incision on the center cone 60 of the flight part 18. More or fewer shoulders can be provided depending on the how that center cone is constructed. The fight part is pressed onto the locking portion so that the edges of the triangular portions on the center cone of the flight part fit between the shoulders on the locking portion, securing the flight part in place. The forward edge of the back cone 86 has a diameter that is wider than the shoulders, and thus can help to prevent the flight part from accidentally being pushed too far back. In this arrangement, the flight part and the retainer are locked against rotation with respect to each other. In other embodiments, those two parts could be left free to rotate with respect to each other, or secured against rotation by obvious modifications of the disclosed arrangement.

The Bearing

Figure 13:
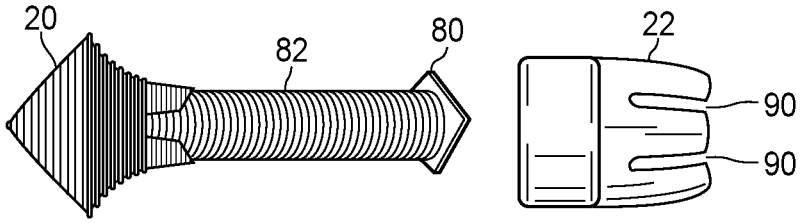
FIG. 13 is an exploded view of the hub and a matching bearing.
Figure 14:
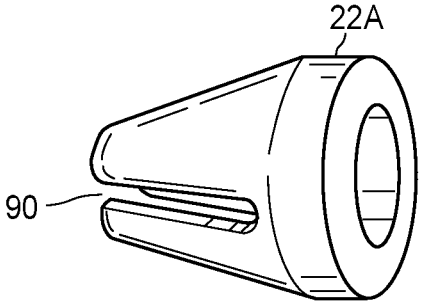
FIGS. 14-16 are views of an alternate bearing.
Figure 15:
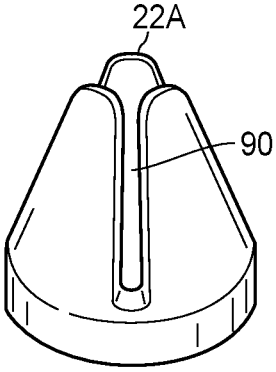
Figure 16:
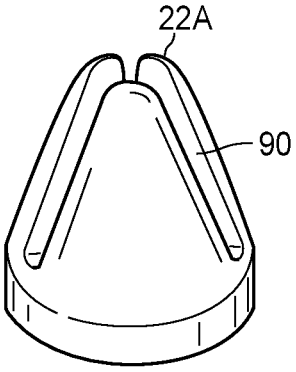

After the flight part 18 is secured on the retainer 20, the self-lubricating bearing 22 (FIG. 13) is slidingly fit over the shaft 82 of the retainer. The bearing is arranged to rotate with respect to the shaft. The bearings 22 and 22A illustrated in FIGS. 13-16 each have one or more slits 90 along its axial direction, enabling the bearing it to expand slightly while being pressed over the knob 80 of the retainer 20. The illustrated bearing is approximately 3/16" long and has an internal diameter of approximately 1/16" and an external diameter that fits securely into the back end of the stem. Once the bearing is on the shaft, the retainer is mounted in the back end of the stem 12. For stems with a larger diameter, an alternative bearing can be used.

After installation of the bearing 22 on the stem 12, the knob 80 on the retainer 20 prevents the retainer (and, with it, the flight part 18) from being withdrawn from the stem.

Alternate Embodiment

Figure 17:
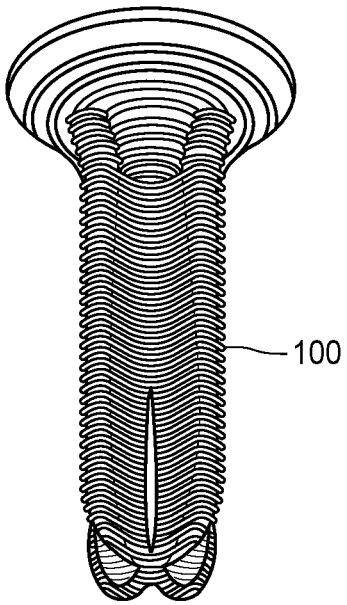
FIGS. 17 and 18 are views of an alternate hub.
Figure 18:
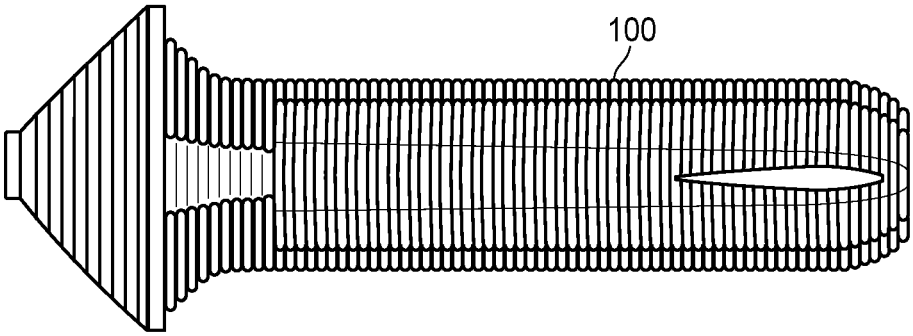
Figure 19:
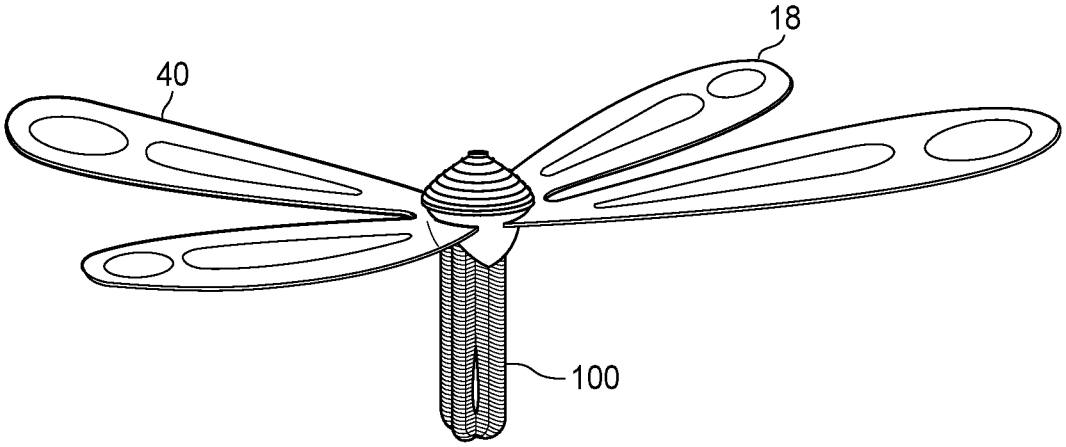
FIG. 19 is a view of the flight part installed on the alternate hub.

The same flight part 18 can alternatively be mounted on a one-piece retainer 100 as seen in FIGS. 17 and 18. This retainer requires no bearing, and has no distinct shaft. Instead, the shoulders extend axially for approximately 3/8" and, after installation of the flight part 12 (as seen in FIG. 19) can be secured directly into the back end of the stem 12. In this embodiment, the blades 40 do not rotate with respect to the stem 12.

Figure 20:
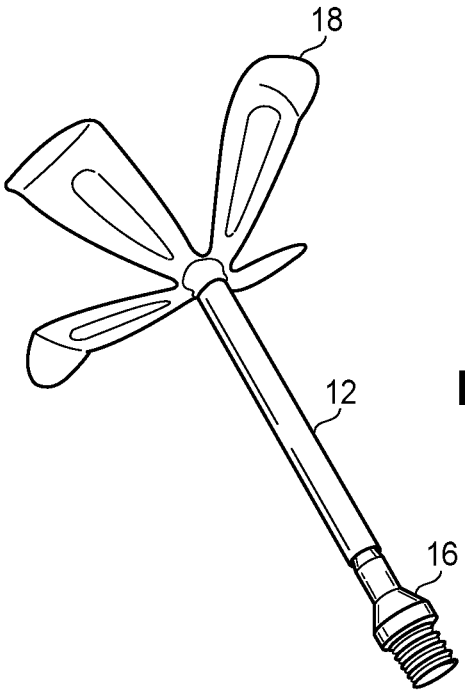
FIGS. 20 and 21 are views of a flight using the invention.
Figure 21:
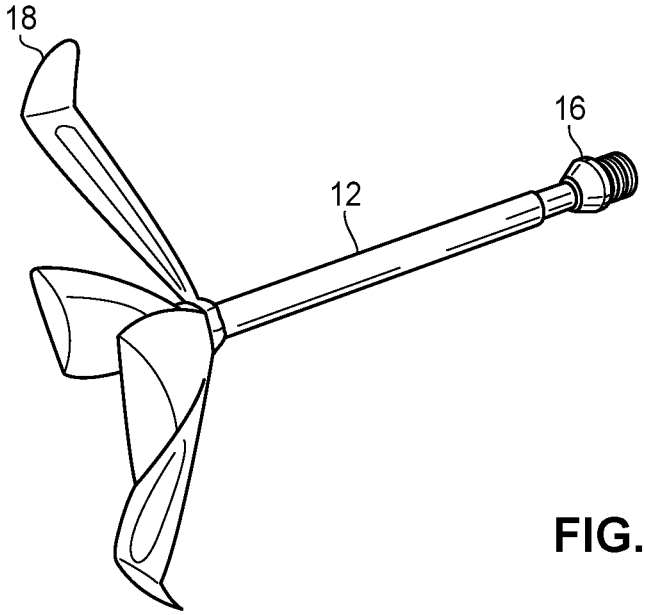
Figure 22:
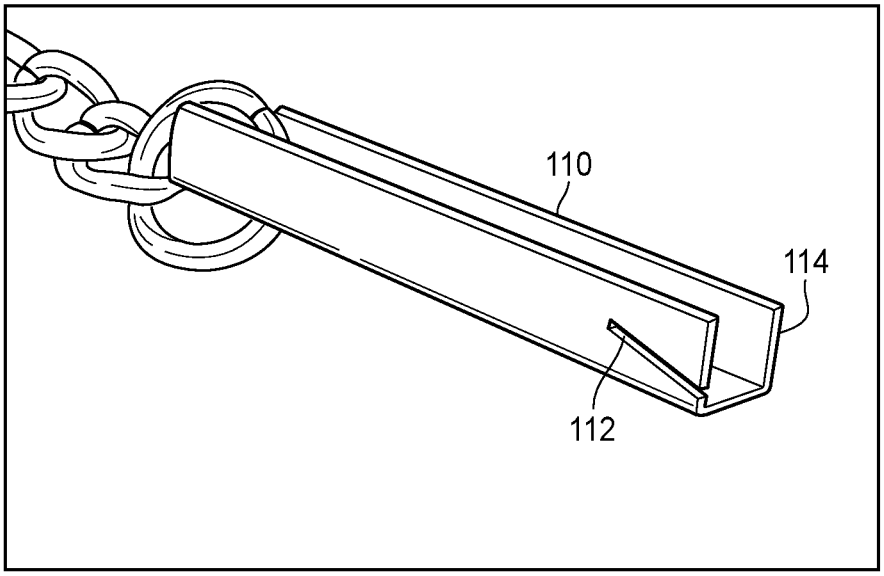
FIG. 22 is a view of a tool that can be used for bending the tips of the blades of the flight part.

The stem 12 with a connected flight part 18 can then be screwed to the back end of a barrel 16, as seen in FIGS. 20 and 21, in the process of assembling a completed dart.

Associated Tool

The tips of the blades 40 of the flight part 18 can be readily bent using a tool 110 in which a slot 112 is cut in one end of a u-shaped channel 114. The illustrated tool is 1" long, 3/16" wide, and 1/8" tall, made of plastic. The illustrated slot is cut at an angle to preserve the strength of the tool. To use it, the tip of a blade is inserted in the slot and bent while the tip is held there.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A dart that has:

a stem with a longitudinal axis;

a tip and a barrel that are connected to a front end of the stem;

an integrally formed flight part that is made of thin plastic with a uniform thickness;

a set of flexible blades that are on the flight part, extend from a central portion of the flight part, are radially offset from each other at equal angular distances, and are arranged with the width of each blade extending in a radial direction, perpendicular to the longitudinal axis of the stem; and edges on the central portion that engage cooperating surfaces on a retainer, locking the retainer and the flight part against rotation with respect to each other.

2. A dart as recited in claim 1, that also has:

a self-lubricating bearing that mounts to the barrel and fits over a stem on the retainer enabling rotation of the retainer with respect to the barrel.

3. A dart flight that has:

an integrally formed flight part that is made of thin plastic with a uniform thickness;

a set of flexible blades that are on the flight part, extend from a central portion of the flight part, are radially offset from each other at equal angular distances, and are arranged with the width of each blade extending in a radial direction, perpendicular to the longitudinal axis of a stem on a retainer;

edges on the central part that engage cooperating surfaces on the retainer, locking the retainer and the flight part against rotation with respect to each other; and a self-lubricating bearing that mounts to the barrel and fits over the stem on the retainer enabling rotation of the retainer with respect to the barrel.

4. A dart that includes the dart flight of claim 3.

5. An integrally formed flight part that is for a dart and:

is made of thin plastic with a uniform thickness;

has a set of flexible blades that extend from a central part, are offset from each other at equal angular distances, and are arranged with the width of each blade extending in a radial direction;

has a channel that extends along the length of each blade, from a proximal section near the central part of the flight part to a distal end on the distal half of the blade, the channel having a maximum depth that exceeds the thickness of the thin plastic by a factor of at least four;

a bubble that is positioned outwardly of the channel on each blade, the bubble having a maximum depth that exceeds the thickness of the thin plastic by a factor of at least four.

6. A dart flight that has the flight part of claim 5.

7. A dart that has the flight part of claim 5.

8. A dart as recited in claim 7 that also has:

a stem with a longitudinal axis;

a tip and barrel that are connected to a front end of the stem;

edges on the central part of the flight part that engage cooperating surfaces on a retainer, locking the retainer and the flight part against rotation with respect to each other; and a self-lubricating bearing that mounts to the barrel and fits over a stem on the retainer enabling rotation of the retainer with respect to the barrel.

* * * * *